US007805942B2

(12) United States Patent
Durso

(10) Patent No.: US 7,805,942 B2
(45) Date of Patent: Oct. 5, 2010

(54) THERMODYNAMIC CYCLE WITH POWER UNIT AND VENTURI AND A METHOD OF PRODUCING A USEFUL EFFECT THEREWITH

(76) Inventor: Thomas Durso, 5522 Madison St., Morton Grove, IL (US) 60053

( * ) Notice: Subject to any disclaimer, the term of this patent is extended or adjusted under 35 U.S.C. 154(b) by 215 days.

(21) Appl. No.: 12/131,448

(22) Filed: Jun. 2, 2008

(65) Prior Publication Data

US 2009/0293479 A1 Dec. 3, 2009

(51) Int. Cl.
*F01K 25/08* (2006.01)

(52) U.S. Cl. ..... 60/651; 60/671

(58) Field of Classification Search ..... 60/651, 60/671

See application file for complete search history.

(56) References Cited

U.S. PATENT DOCUMENTS 1,911,067 A * 5/1933 Doble ..... 60/664
2,360,969 A 10/1944 Newcombe
3,052,106 A 9/1962 Sampietro et al.
3,500,656 A 3/1970 Lofgreen et al.
3,817,055 A 6/1974 Hosokawa
3,864,919 A * 2/1975 Frutschi ..... 60/657
4,262,495 A 4/1981 Gupta et al.
4,334,411 A 6/1982 Payne
4,345,440 A 8/1982 Allen et al.
4,350,019 A 9/1982 Chocas
4,422,301 A 12/1983 Watt et al.
4,668,341 A * 5/1987 Nilsson ..... 162/23
5,186,013 A 2/1993 Durso
5,524,442 A * 6/1996 Bergman et al. ..... 62/86
7,010,920 B2 * 3/2006 Saranchuk et al. ..... 60/670
2007/0095079 A1 * 5/2007 Sterling ..... 62/115

* cited by examiner

*Primary Examiner*—Hoang M Nguyen
(74) *Attorney, Agent, or Firm*—Vedder Price P.C.

(57) ABSTRACT

This disclosure relates to a improved thermodynamic cycle with power unit and venturi, a method of producing a useful effect therewith using a greater pressure gradient created locally in a fluid using the venturi, and more particularly, the use of a first portion of the fluid in the thermodynamic cycle as driving force for a venturi, and the placement of the venturi nozzle in an exhaust area of the power unit to create a greater pressure gradient locally and collect a second portion of the fluid in the thermodynamic cycle.

27 Claims, 12 Drawing Sheets

THERMODYNAMIC CYCLE WITH POWER UNIT AND VENTURI AND A METHOD OF PRODUCING A USEFUL EFFECT THEREWITH

FIELD OF THE DISCLOSURE

This disclosure relates to a improved thermodynamic cycle with power unit and venturi, a method of producing a useful effect therewith using a greater pressure gradient created locally in a fluid using the venturi, and more particularly, the use of a first portion of the fluid in the thermodynamic cycle as a driving force for a venturi and the placement of the venturi nozzle in an exhaust area of the power unit to create a greater pressure gradient locally and collect a second portion of the fluid in the thermodynamic cycle.

BACKGROUND

A thermodynamic cycle is a series of thermodynamic processes placed in a closed loop forcing a fluid, most often a gas, to undergo thermodynamic changes in state. Examples of equipment operating with a thermodynamic cycle include refrigerant power units, car engines, air cooling systems, power plants, etc.

The object of all thermodynamic cycles is to use a fluid to transport energy from a first location, found in a first form, to a second location to create a wanted and useful effect, often in a second form. For example, in a car engine, gas is burned in a cylinder to create a pressure wave captured by a cylinder and ultimately transformed into a driving force for a vehicle. In the cylinder, air is used in an open thermodynamic cycle as the fluid. For refrigeration units, the object is to remove heat from a volume, a surface, or a fluid using energy from a compressor. To improve the refrigeration capacity, a compressed gas with phase change can be used in association with heat transfer plates to pump heat from the surface. U.S. Pat. No. 5,186,013 from the inventor of the present disclosure describes such a refrigeration power unit and method of refrigeration. U.S. Pat. No. 5,186,013 is hereby incorporated herein by reference.

For power plants, the object is often to energize a turbine into producing electricity using water or steam as the fluid, which is heated in contact of a heating source such as a reactor or a boiler. Turbines may be equipped with a central cylindrical shaft and radial pales that are forced into rotation by the heated fluid. The fluid operates at a great velocity and associated high pressure, contacts a first surface of turbine pales to create rotational movement around the cylindrical shaft as long as the reverse surface of each pale (i.e., the second surface) is in a relatively depressurized environment. The momentum on the turbine can be calculated as the pressure differential ($\Delta P$) on each pale multiplied by the surface of the pale and the distance of the center of the pale from the shaft.

Fluids in thermodynamic cycles can be quantified at different states either using immediately measurable physical properties of the fluid such as pressure, temperature, or velocity. Cycle states can also be evaluated and quantified using thermodynamic variables created from a plurality of these measurable physical properties. These thermodynamic variables are often better suited to understand the difference in "useful energy" between the different states of the fluid, and these variables include entropy, often referred to as the measure of a system's energy to do work, and enthalpy, or the value of useful work obtainable in heat from a closed thermodynamic system under constant pressure and entropy.

Entropy is also described as a form of energy broken down into irretrievable heat in the system.

Within this disclosure, temperatures are shown in degrees Fahrenheit (° F.), pressure is given in pounds per square inch absolute (PSIA) where the absolute measure includes atmospheric pressure, the specific volume of the fluid is given in cubic feet per pound ($ft^3/lb$), enthalpy is given in British thermal unit per pound (BTU/LB), and entropy is given in British thermal unit per pound Rankin (BTU/LB°R). The use of the British unitary system is only exemplary, and any system, such as the metric system, can be used, as well as any combination of systems.

The embodiment described of the current disclosure is directed primarily to the thermodynamic power cycle where no change in phase of the fluid is needed and power is transferred through the fluid at different positions in the cycle based on the stored energy in the transport fluid. One of ordinary skill in the art knows that power cycles can also be used as part of a refrigeration cycle or to energize other types of device, and phase changes along with different fluids can be used based on operating requirement of the thermodynamic cycle.

What is known in the art is the use of a wheel-based turbine with pales on a shaft where pressurized fluid is pushed against the outer portion of the pales to initiate rotation of the turbine around a central shaft, which in turn produces electrical power or energy for refrigeration. In the prior art, once the fluid has delivered its energy to the pale and ultimately the power unit, the fluid is evacuated via conventional means into an exhaust chamber via an exhaust port away from the system (in the case of open loops) or back into the system (in the case of closed loops). What is needed is a power cycle having the capacity to draw greater force from a fluid pressurized at a fixed value without an increase in pressure, temperature, or velocity of the driving fluid. What is also needed is an improved means to evacuate exhaust fluids from the power unit without the need of a specific source of energy to remove the exhaust fluids.

SUMMARY

This disclosure relates to a improved thermodynamic cycle and method of producing a useful effect therewith. To improve the efficiency of the overall thermodynamic cycle, the pressure gradient available to the power unit, or the available force to produce power or any useful effect when applied to a useful surface, is increased using an inline venturi in the thermodynamic loop.

The principal flow of the thermodynamic cycle is directed to an internal portion of the venturi connected with the venturi effect at a choked section to a nozzle. Energy from a primary fluid is used to siphon off through the nozzle of the venturi fluid in the exhaust portion of the power unit or any other device to produce useful effect. In addition to siphoning off the exhaust area, the venturi nozzle helps create a depression that in turn increases the pressure differential on the pales of the driving shaft of the power unit.

BRIEF DESCRIPTION OF THE DRAWINGS

Certain preferred embodiments are shown in the drawings. However, it is understood that the present disclosure is not limited to the arrangements and instrumentality shown in the attached drawings.

DETAILED DESCRIPTION

Figure 1:
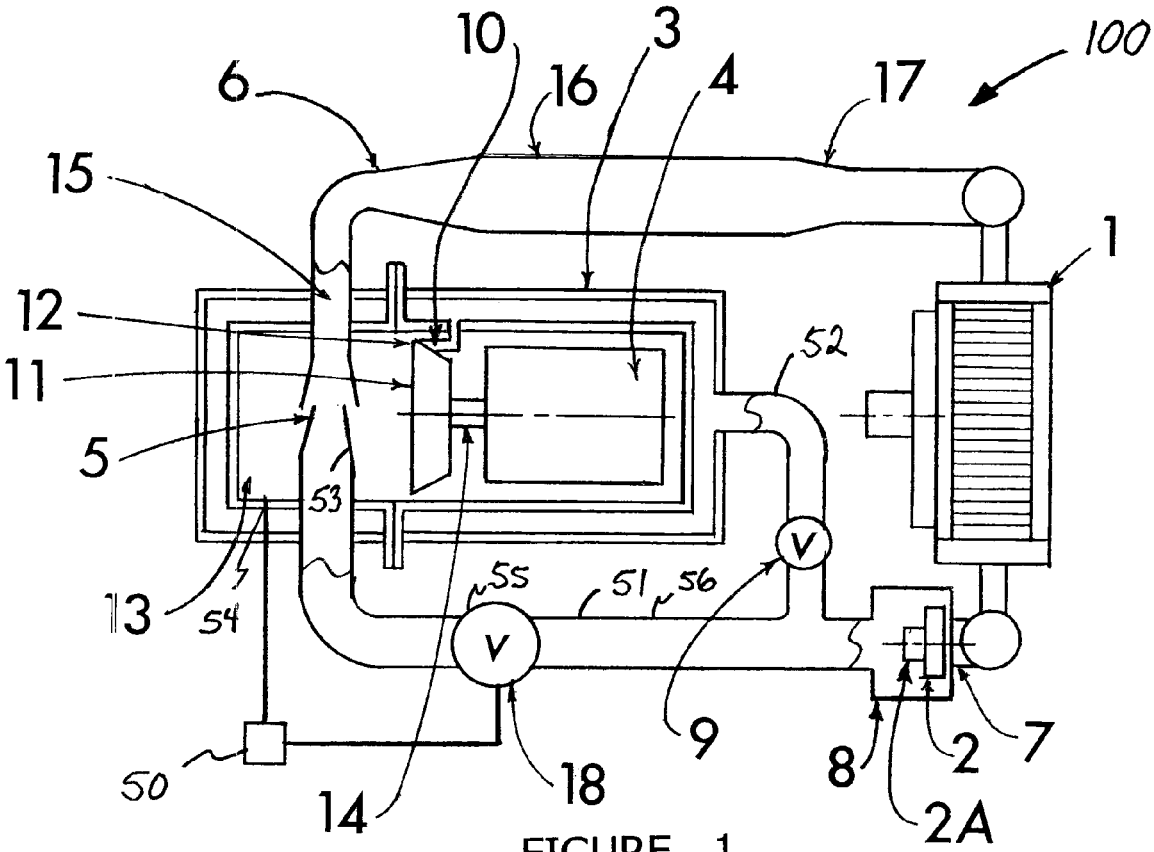
FIG. 1 a functional diagram of a thermodynamic cycle with venturi according to a first embodiment of the present disclosure.
Figure 1A:
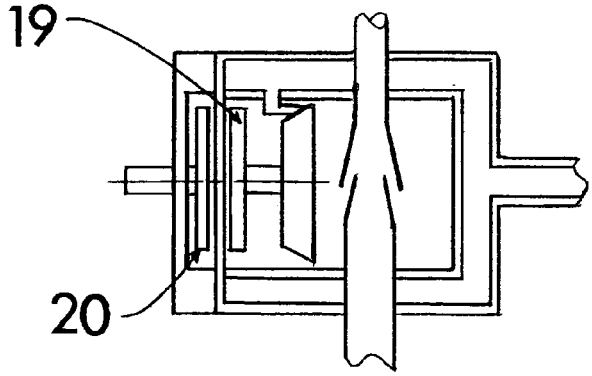
FIG. 1A is a functional diagram of a power unit as shown in the thermodynamic cycle of FIG. 1 with gears instead of a generator.

For the purposes of promoting and understanding the invention and principles disclosed herein, reference is now made to the preferred embodiments illustrated in the drawings, and specific language is used to describe the same. It is nevertheless understood that no limitation of the scope of the invention is thereby intended. Such alterations and further modifications in the illustrated devices and such further applications of the principles disclosed as illustrated herein are contemplated as would normally occur to one skilled in the art to which this disclosure relates.

While the current disclosure describes with greater particularity closed thermodynamic cycles, the implementation of this disclosure to both closed cycles an open-loop cycles where one or more of the processes of the open cycle can be bypassed by using an atmospheric or stored fluid found at a first thermodynamic state and releasing the fluid at a second state is contemplated. Examples of open thermodynamic cycles include on-board air cooling systems where external air is introduced in the system and power plants.

Referring to the drawings, FIG. 1 illustrates a physical embodiment of the thermodynamic cycle 100 also shown on a thermodynamic chart as FIGS. 2-11. In the physical embodiment of FIGS. 1 and 12, the cycle is a refrigeration system comprising a closed loop containing a heat exchanger 1, a fan 2, and associated motor 2A, a housing 3 containing a turbine-driven electric generator 4, a venturi nozzle 5, and a venturi tube 16. The cycle shown in FIG. 12 further comprises a heat exchanger coil 19. The structure illustrated in FIGS. 1 and 12 includes an internally moving fluid, which is not shown directly but is shown schematically in FIGS. 2-11. As is known in the art, in thermodynamic cycles, the different fluid properties given and illustrated in FIGS. 2-11 are to be taken as average values over a cross-section of the flow with reasonable precision. For example, in portions such as the nozzle 10, or the blades 12, gradients and fluctuations in properties can be important but do not impact the average value of the enthalpy and entropy of the fluid as it travels along the loop and moves from one thermodynamic state to the next.

Each of FIGS. 2-10 describes state-based diagrams of the thermodynamic fluid shown in FIG. 1 where the three different principal states of the fluid are shown as points A, B, and C for the auxiliary loop. These diagrams correspond to different ranges of application of the thermodynamic cycle with progressively greater temperature gradients, pressure variations, and energy transfer. In these figures, three arrows illustrate how the fluid passes from state A, to state B, and on to state C before returning to state A in what is a classical thermodynamic cycle 100. Illustratively, the average fluid particle, when directed to the auxiliary loop will travel the path from state A, to B, to C and back to A repetitively. In the case of an open loop, one of the three paths will be absent and new fluid at the next state on the diagram will be inserted. For example, in the case of a power plant, water from a river travels from state A to state B before it is released back to the environment. New river water at state A is then introduced into the open loop.

Figure 2:
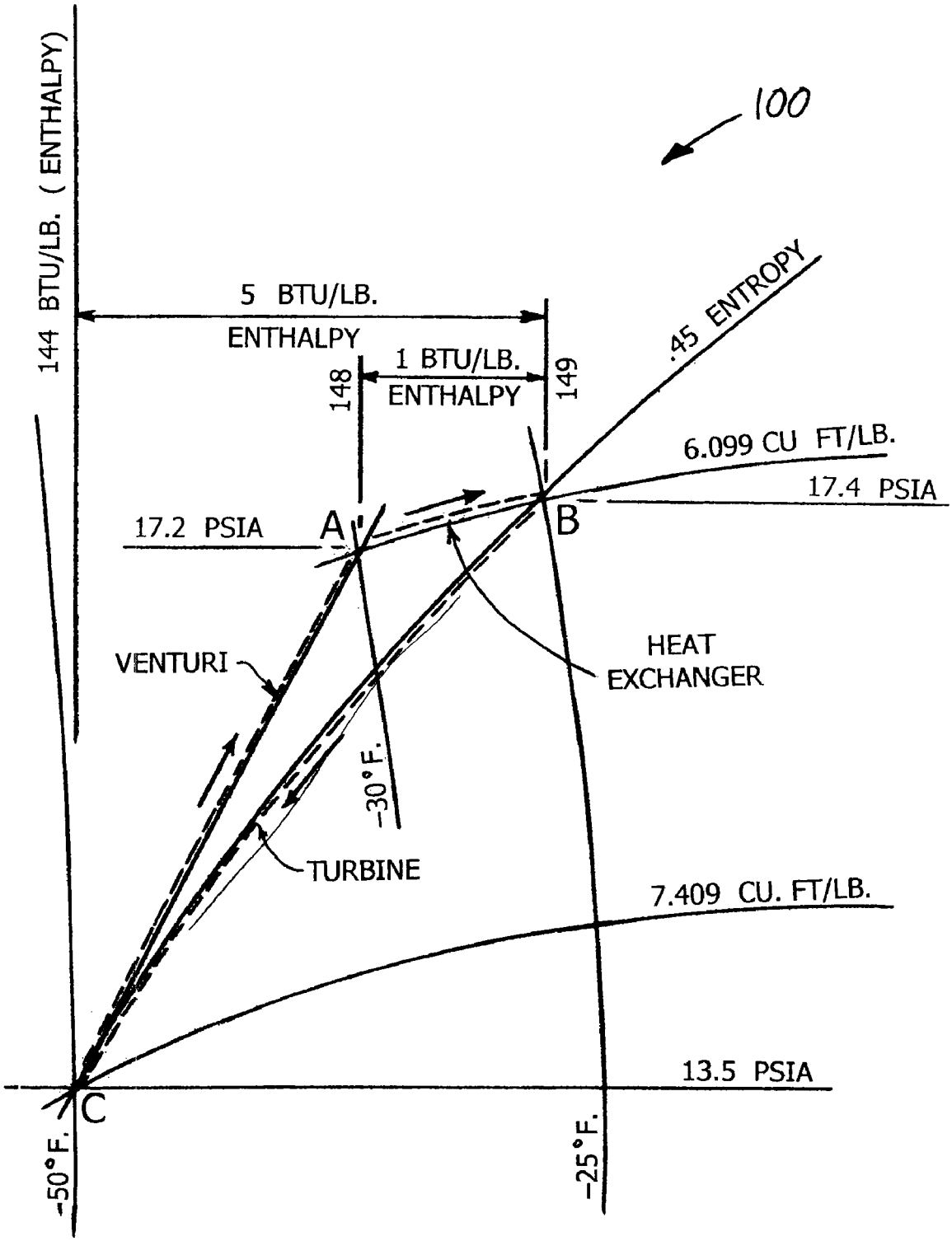
FIG. 2 is a thermodynamic state representation of the fluid in an auxiliary loop, where the variation of temperature at the turbine is 25° F. and the variation of pressure at the turbine is 3.9 PSIA according to one embodiment of the present disclosure.
Figure 3:
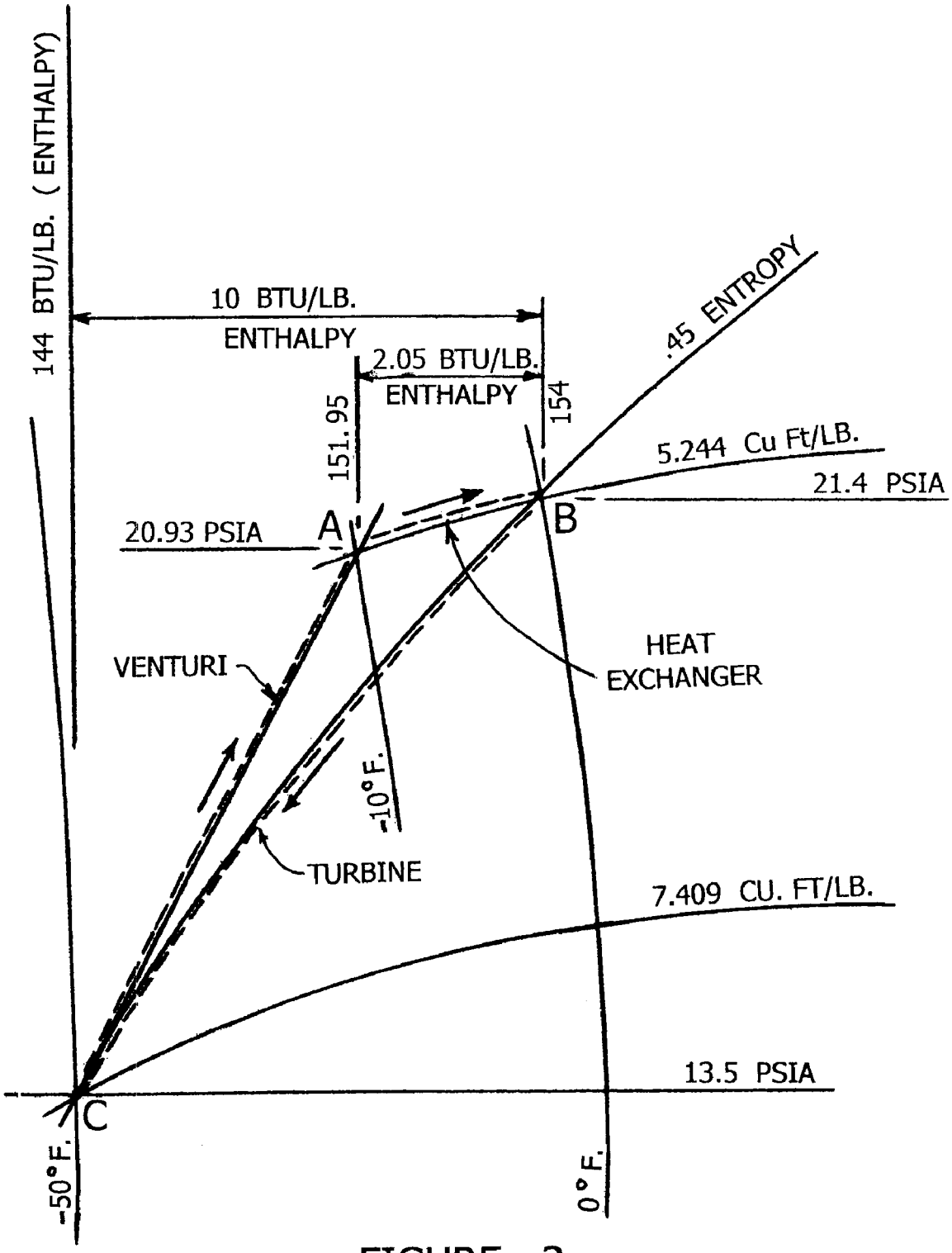
FIG. 3 is a thermodynamic state representation of carbon dioxide gas in an auxiliary loop, where the variation of temperature at the turbine is 50° F. and the variation of pressure at the turbine is 7.9 PSIA according to another representation of the present disclosure.
Figure 4:
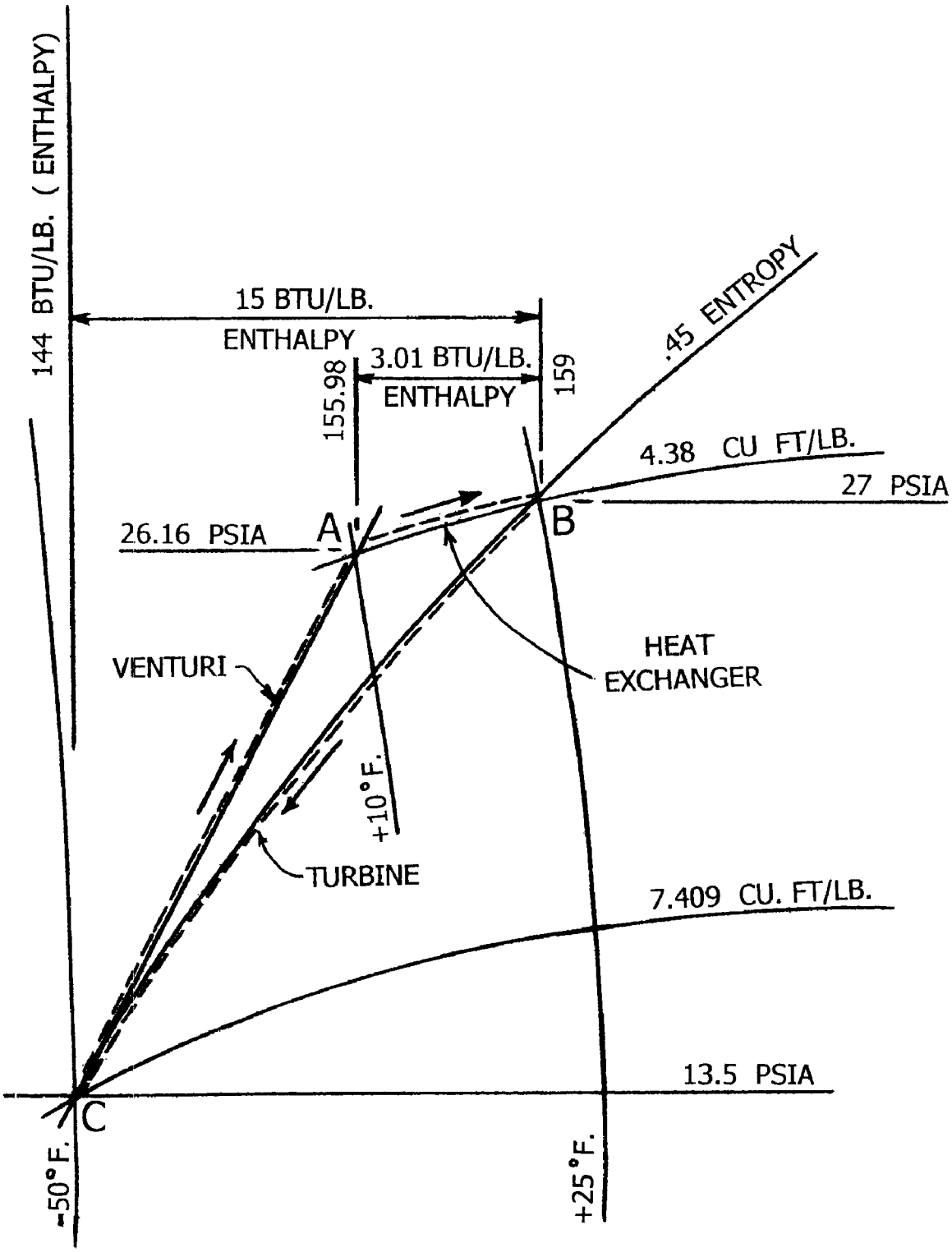
FIG. 4 is a thermodynamic state representation of carbon dioxide gas in an auxiliary loop, where the variation of temperature at the turbine is 75° F. and the variation of pressure at the turbine is 13.5 PSIA according to another representation of the present disclosure.
Figure 5:
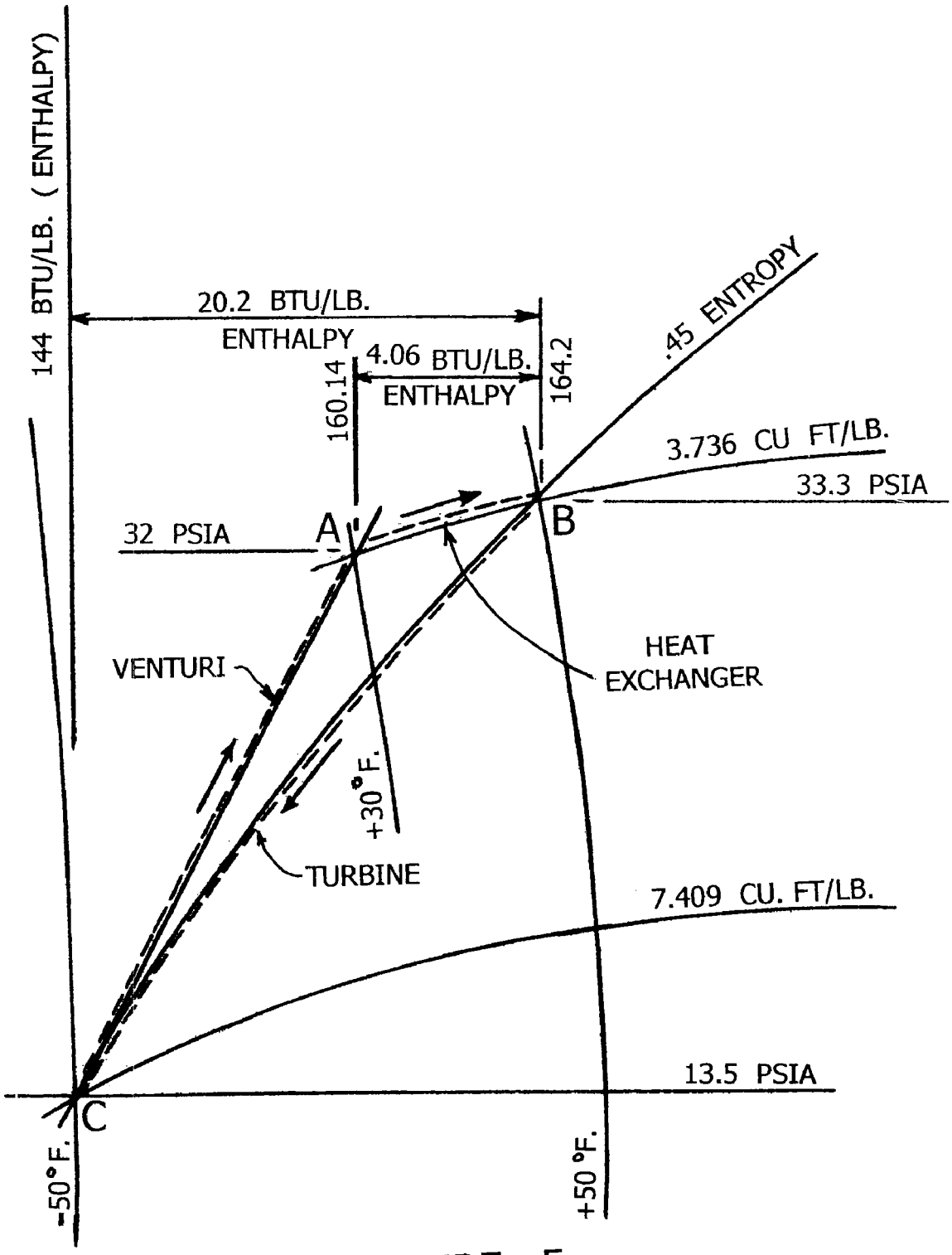
FIG. 5 is a thermodynamic state representation of carbon dioxide gas in an auxiliary loop, where the variation of temperature at the turbine is 100° F. and the variation of pressure at the turbine is 19.8 PSIA according to another representation of the present disclosure.
Figure 6:
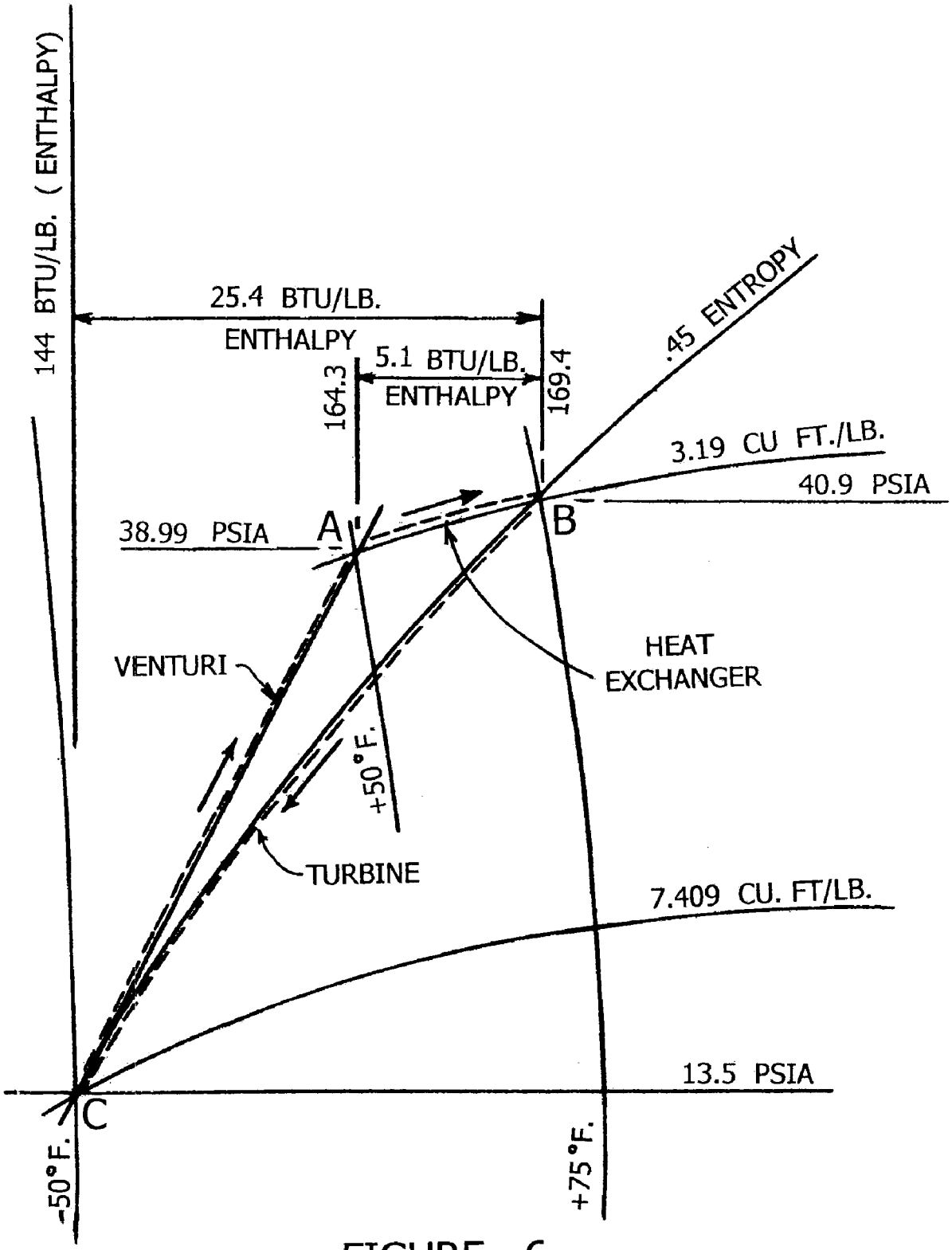
FIG. 6 is a thermodynamic state representation of carbon dioxide gas in an auxiliary loop, where the variation of temperature at the turbine is 125° F. and the variation of pressure at the turbine is 27.4 PSIA according to another representation of the present disclosure.
Figure 7:
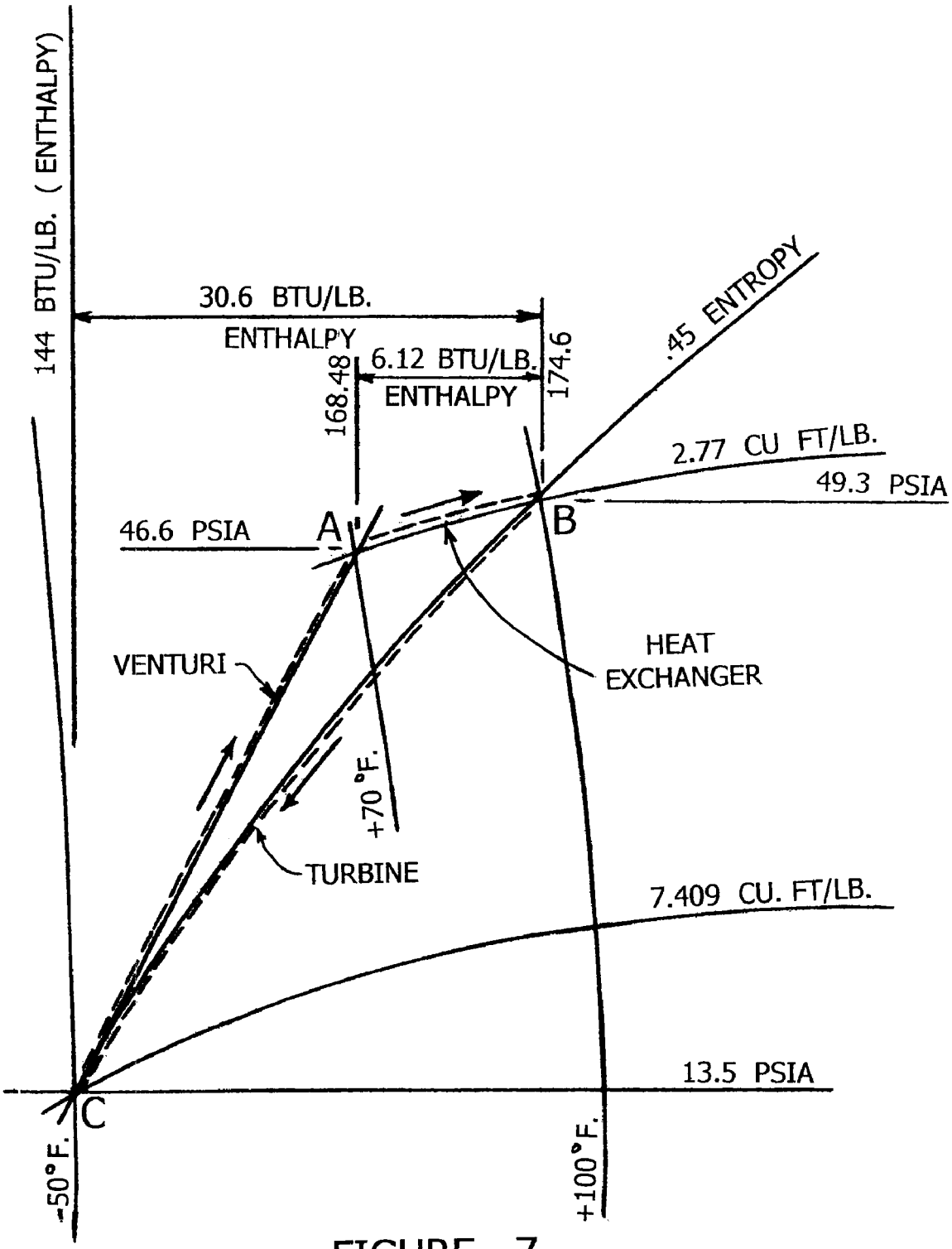
FIG. 7 is a thermodynamic state representation of carbon dioxide gas in an auxiliary loop, where the variation of temperature at the turbine is 150° F. and the variation of pressure at the turbine is 35.8 PSIA according to another representation of the present disclosure.
Figure 8:
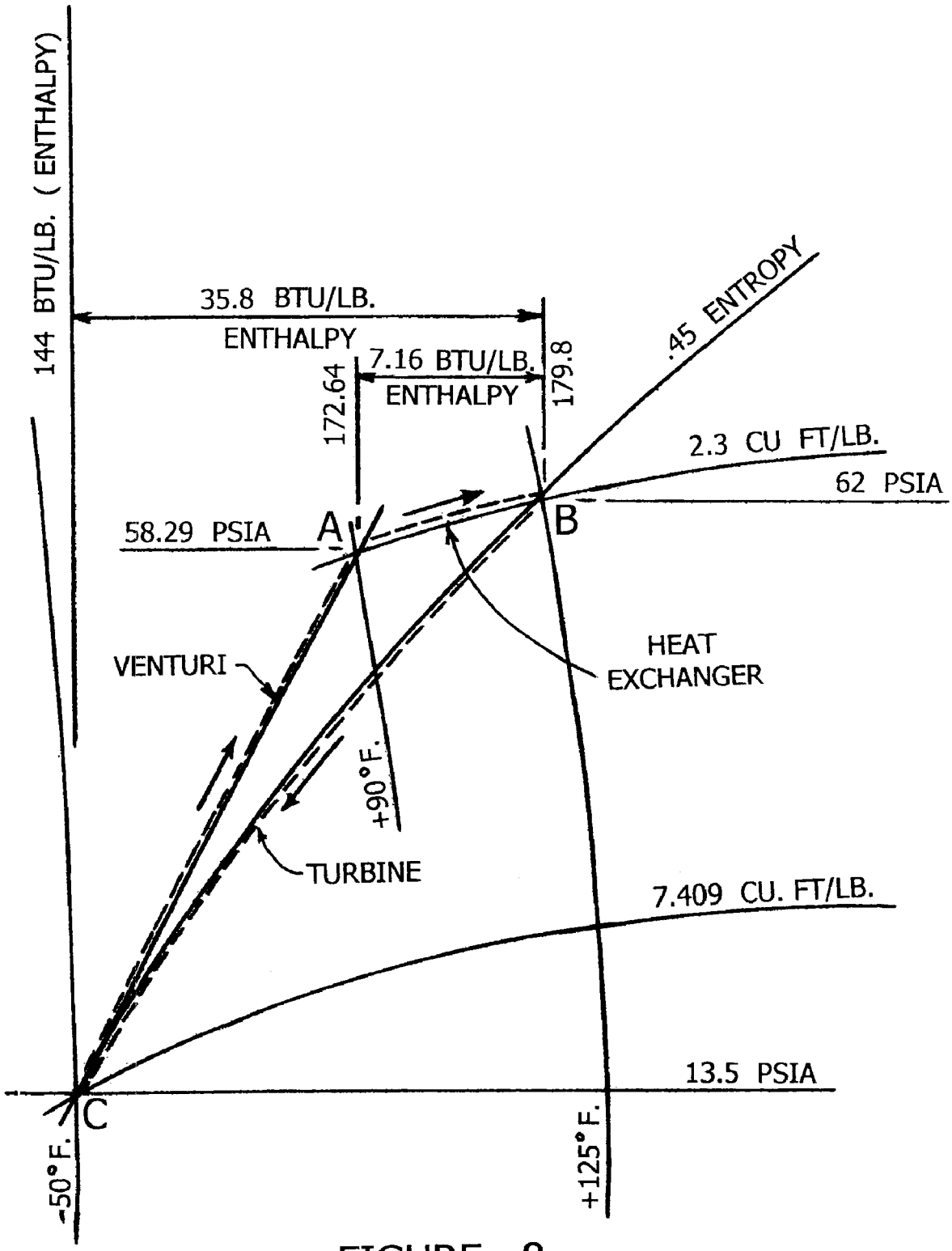
FIG. 8 is a thermodynamic state representation of carbon dioxide gas in an auxiliary loop, where the variation of temperature at the turbine is 175° F. and the variation of pressure at the turbine is 48.5 PSIA according to another representation of the present disclosure.
Figure 9:
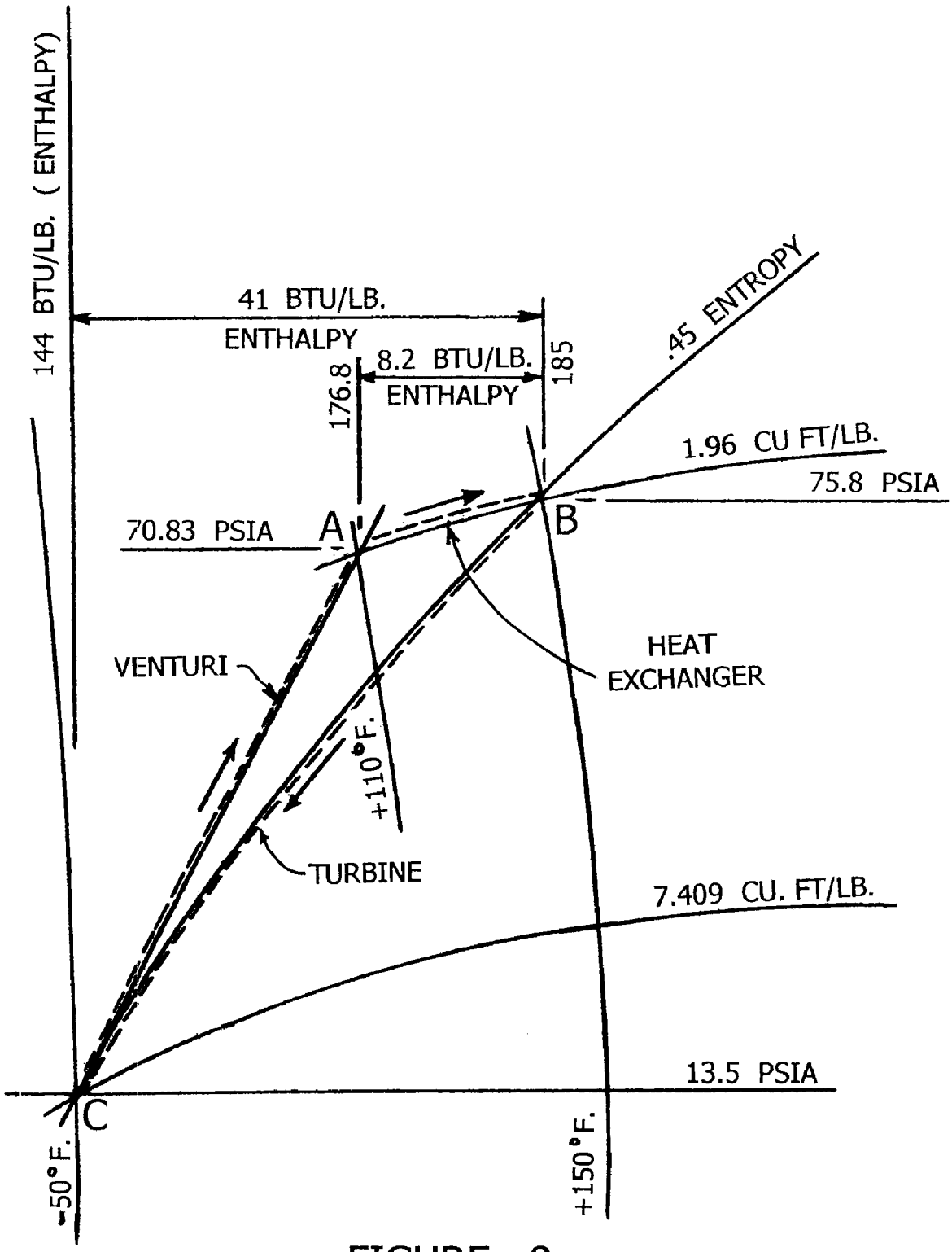
FIG. 9 is a thermodynamic state representation of carbon dioxide gas in an auxiliary loop, where the variation of temperature at the turbine is 200° F. and the variation of pressure at the turbine is 62.3 PSIA according to another representation of the present disclosure.
Figure 10:
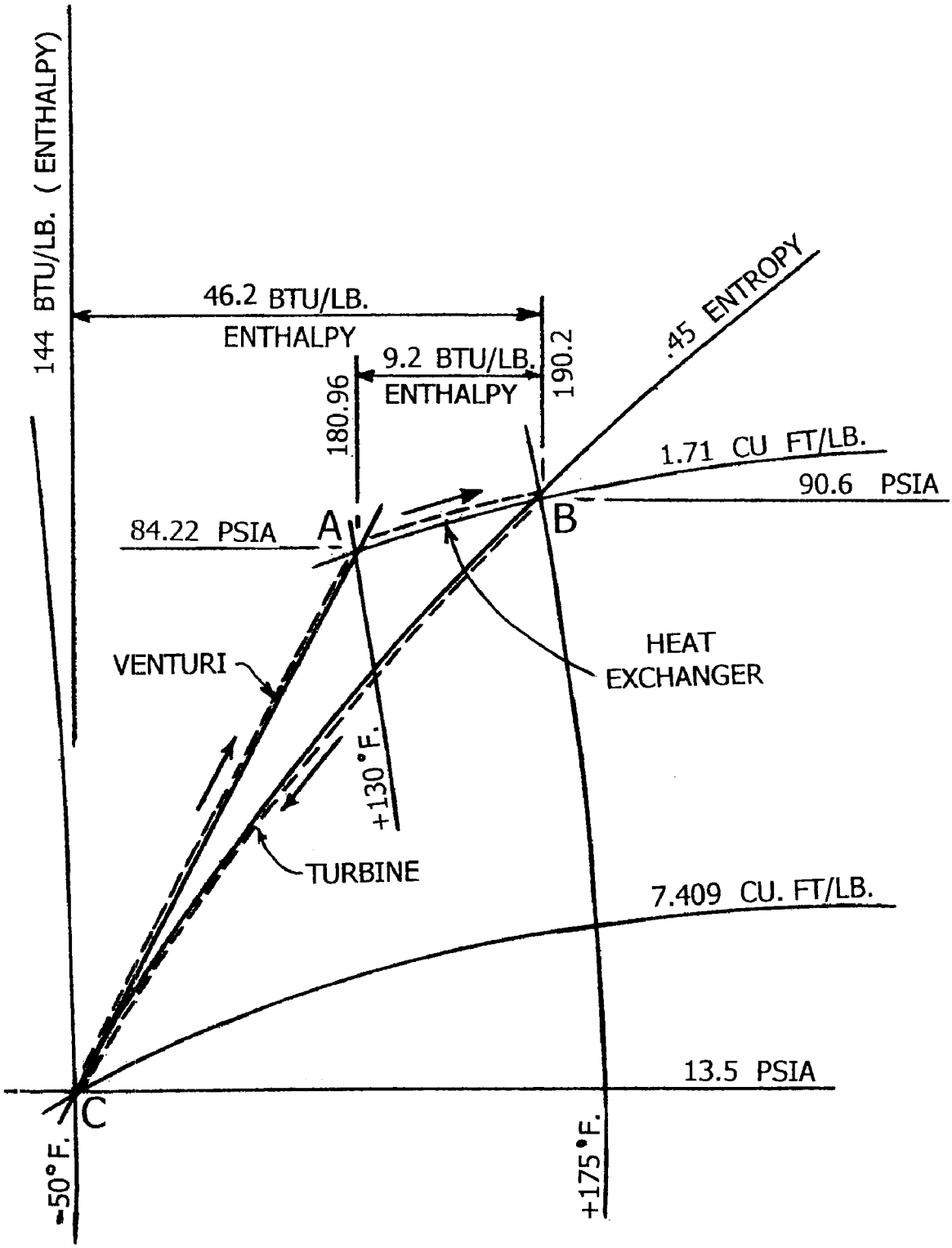
FIG. 10 is a thermodynamic state representation of carbon dioxide gas in an auxiliary loop, where the variation of temperature at the turbine is 225° F. and the variation of pressure at the turbine is 77.1 PSIA according to another representation of the present disclosure.

The heat exchanger 1 heats up the fluid in what is shown as a passage from point A to point B. In one embodiment shown in FIG. 2, a slight pressure increase is registered by 0.2 PSIA corresponding to an evolution at constant specific volume of 6.099 $ft^3$/lb. In FIG. 2, the enthalpy of the fluid increases by 1 BTU/lb after its passage through the heat exchanger 1. The fluid then proceeds past the fan 2 and associated motor 2A and is directed with the help of one or two control valves 9, 18 with or without individual control of the flow 50 to two different branches shown as a primary loop 51 and an auxiliary loop 52. What is understood by one of ordinary skill in the art is the fact that if a single valve is used in a configuration, the remaining flow adjusts in the other branches of the network. If more than two branches are used, regulation may be made with valves or through the calibration of the flow resistance at each branch.

In one preferred embodiment, the structure includes two loops and more flow is directed to the primary loop 51 than in the auxiliary loop 52. The ratio of the flow in the primary loop 51 to flow in the auxiliary loop in a preferred embodiment is greater than one to energize the venturi with sufficient flow. In yet another embodiment, the ratio of the flow in the primary loop 51 to flow in the auxiliary loop 52 is approximately 10 to 1, which corresponds to a flow of about 90% in the primary loop 51. The need to use a majority of flow in the primary loop 51 where the fluid is connected to the internal portion of the venturi is based upon the physical characteristics of a venturi 15 operating under the Bernoulli equation as defined by Giovanni Battista Venturi in the 19th century.

A venturi is a primary conduit with an initial section where a main fluid is moving at a first velocity ($v_1$) and is suddenly choked to increase the velocity across the choked area ($v_2$). At the choked area, the pressure drops as described by Bernoulli. A nozzle, once connected to the choked area, also decreases in pressure, creating a pressure drop $\Delta P$ at the nozzle between the pressure of the main fluid and the fluid next to the nozzle. The theoretical pressure drop can be calculated as $\Delta P=(\rho/2)*(v_2^2-v_1^2)$ where $\rho$ is the specific density of the fluid. One of ordinary skill in the art understands from the following that the pressure drop at the nozzle can be adjusted based on the different sectional areas of the primary flow and the choked area, as well as the density of the fluid. Geometric parameters can thus be adjusted to obtain the needed pressure drop for a multitude of configurations.

A power unit 4 is placed in the thermodynamic cycle 100 via a housing 3. A small opening, such as a housing nozzle 10 described in greater detail in U.S. Pat. No. 5,186,013, is used to funnel the fluid onto the blades 12 of the power unit 4. The contact of the fluid with a specific portion of the power unit 4 creates power at the output by activating engaging elements, such as blades 12 in one embodiment, attached to a shaft 14 of the power unit 4. The engaging elements, such as blades 12, have a first surface exposed to the incoming fluid and a second surface in opposition to the first surface exposed to the outgoing fluid.

In one embodiment, the engaging element is placed in the thermodynamic cycle 100 and the fluid is defined in the front end of the engaging element in a high pressure, and in the back end of the engaging element at a low pressure such as an exhaust chamber 13. In FIG. 2, what is shown is the average thermodynamic property of a portion of the fluid as it moves through the loop 100. The thermodynamic state of the fluid slides down from position B to position C. The fluid in the exhaust chamber 13 containing the fluid passed in the auxiliary loop 52 is then merged via the nozzle of the venturi 5 back with the principal loop 51 and the average property of the fluid returns on the path from C to A up to the initial property of the fluid defined in A.

A portion of the fluid from the fan 2 flows through valve 9 to the housing 3 containing a turbine-driven electrical generator 4 or any other power unit. The refrigerant flows through the space between the inner and outer shell of the generator 4 and the housing 3 as the fluid flows through the housing 3 to the turbine nozzles 10. The fluid also absorbs waste heat energy from the generator 4 and increases the fluid gas temperature and enthalpy. Generator 4 is a source of portable electric energy in one embodiment, which can be used to power all types of equipment and vehicles. The power unit 4 may be used to produce electric power for heating, cooling, lighting, and any other electrical needs for homes, buildings, and industry.

After leaving the generator housing 3, the fluid enters the turbine nozzle 10. The fluid passing through the nozzle 10 moves into a region of lower pressure within the piping. In this portion of the cycle, the fluid is flowing as a jet column of high-speed molecules. The nozzle is aligned at a sharp angle to a turbine wheel 11 and directs the fluid to a preselected area on the turbine blades 12 and then into the turbine exhaust chamber 13. As the fluid moves between the blades 12, it expands. By keeping the tangential speeds of the blades 12 slower than the speed of the gas molecules, the jet stream of the fluid turns such that it leaves the turbine blades 12 in a generally axial direction and at a lower speed than that with which it entered the blades 12. The momentum of the molecules is reduced by this change in speed, resulting in a release of most of its kinetic energy. This energy transforms into a force action on the blades 12 to drive a common shaft 14 of the turbine wheel 11 and the generator 4 in a steady rotational motion.

Figure 11:
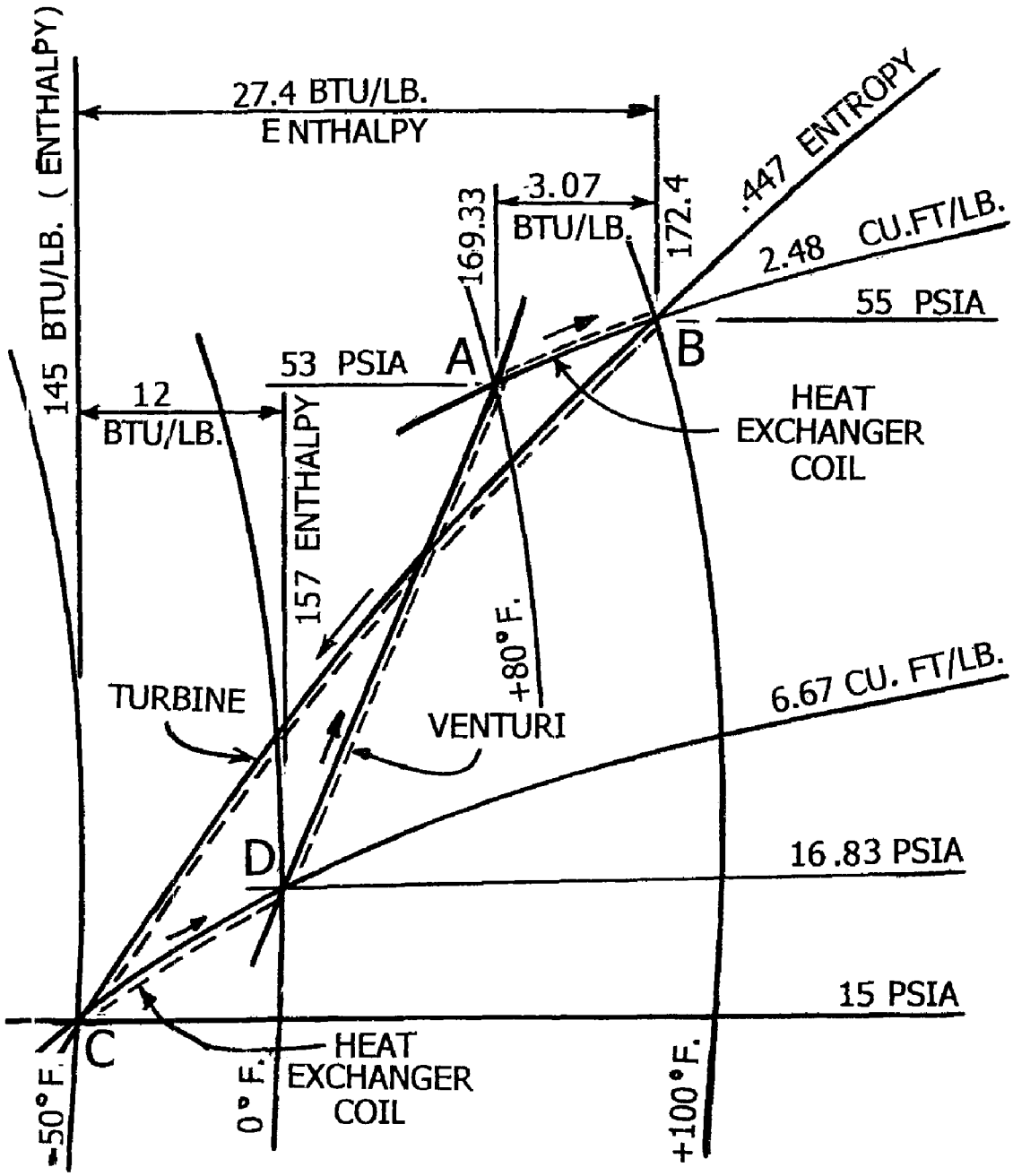
FIG. 11 is a thermodynamic state representation of carbon dioxide gas in an auxiliary loop as shown in FIG. 12, where the variation of temperature at the turbine is 150° F. and the variation of pressure at the turbine is 40 PSIA according to another representation of the present disclosure.
Figure 12:
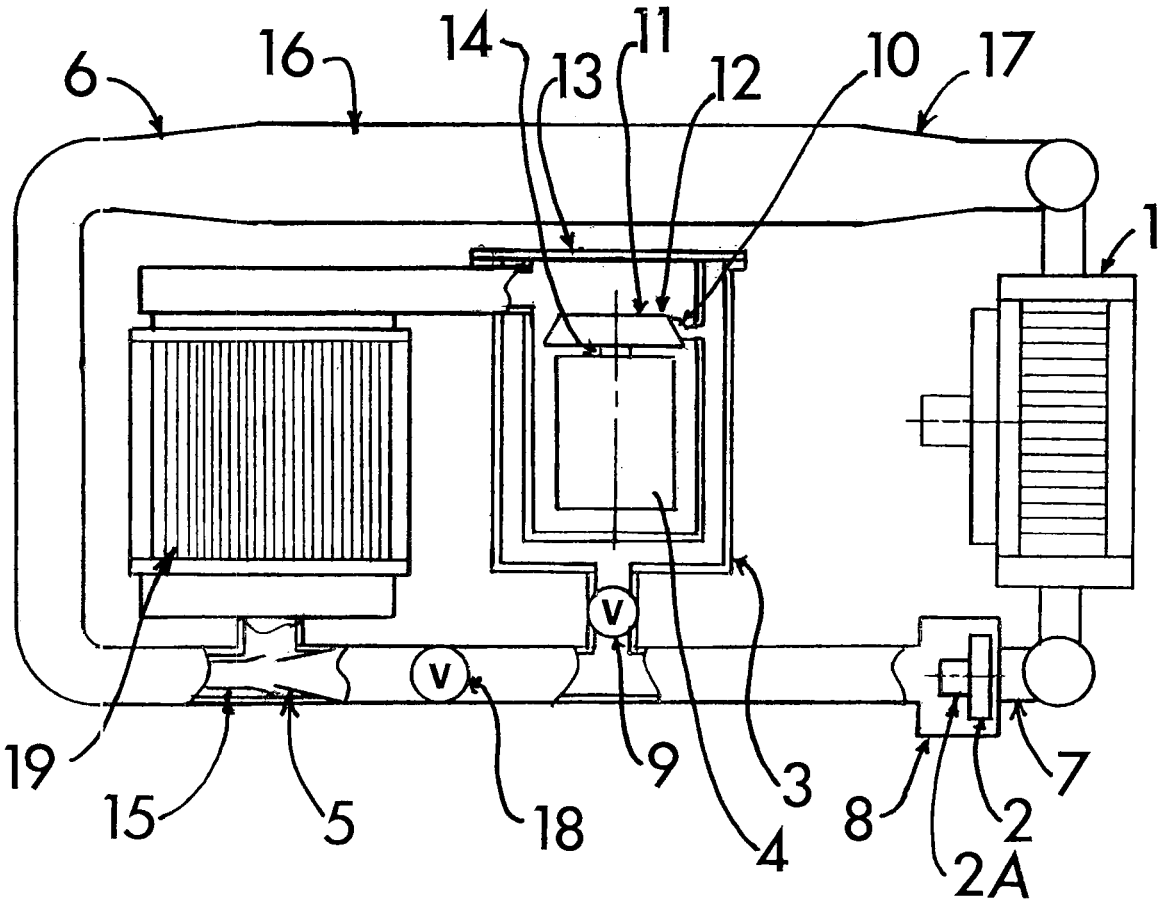
FIG. 12 is a functional diagram of a thermodynamic cycle with venturi and heat exchanger coil according to a second embodiment of the present disclosure.

Nine illustrative examples are given in FIGS. 2-10 for operation at different levels. In the provided examples, the temperature gradient (i.e., the pre- and post-turbine temperature) is fixed to known values ranging from a gradient of 25° F. in FIG. 2, up to a gradient of 225° F. in FIG. 10 by incremental 25° F. increases. As a consequence of the increase in temperature gradient and the pressure variations, and the enthalpy release is increased at a constant entropy of 0.45. FIG. 11 discloses the thermodynamic cycle where a heat exchanger coil creates a subsequent state after the turbine as point D.

What is contemplated is a thermodynamic cycle 100 with a power unit 4 with an engaging element 11 mechanically coupled to the power unit 4, the engaging element 11 having a first surface and a second surface in opposition thereto (not shown in detail), said element 11 being immersed in a fluid shown in FIGS. 2-11 circulating in a thermodynamic cycle, the first surface contiguous to a high-pressure volume 10 such as a nozzle of the thermodynamic cycle, and the second surface contiguous to a low-pressure volume 13 such as an exhaust chamber. A venturi 15 in the thermodynamic cycle 100 with an nozzle 5 is in open communication with the low-pressure volume 13.

Further, the thermodynamic cycle 100 comprises a primary loop 51 for the circulation of a first portion of the fluid of the thermodynamic cycle in an internal portion of the venturi 15 and an auxiliary loop 52 for the circulation of a second portion of the fluid shown in FIGS. 2-11 of the thermodynamic cycle 100 in the nozzle 5. In one embodiment, the thermodynamic cycle 100 is a power cycle. In another embodiment, the thermodynamic cycle 100 is a heat or refrigeration cycle. In one embodiment, the primary loop 51 also includes piping 17, a heat exchanger 1, an electric motor 2, a fan 2A, and the internal portion of the venturi 53. The primary loop 51 also includes a valve 18, a pressure sensor 54, and a flow control 55.

The secondary loop 52 includes piping 56, the high-pressure volume 10, the low-pressure volume 13, and the nozzle of the venturi 5. The secondary loop 52 may also comprise a valve 9 and a heat exchanger coil 19 as shown on FIG. 12. Fluids can be a plurality of media. In one preferred embodiment, carbon dioxide gas is used. In another embodiment, argon gas is used.

In yet another embodiment, what is contemplated is a method of producing a useful effect in a thermodynamic cycle 100, the method comprising the steps of heating a fluid to a first state using a heat exchanger, compressing the fluid at the first state to a second state using an electric motor 2, directing a first portion of the fluid at the second state into an internal portion of a venturi 53, to act as a driving element of the venturi 15, where a nozzle 5 of the venturi is in fluidic contact with an exhaust chamber 13 or the outlet of a heat exchanger coil 19, directing a second portion of the fluid at the second state into an engaging element 12 of a power unit to produce a useful effect, releasing the second portion of the fluid at the second state in a third state into a exhaust chamber 13, and collecting through the nozzle 5 the second portion of the fluid at the third state in the exhaust chamber 13 and merging the fluid with the first portion of the fluid at the second state.

Persons of ordinary skill in the art appreciate that although the teachings of this disclosure have been illustrated in connection with certain embodiments and methods, there is no intent to limit the invention to such embodiments and methods. On the contrary, the intention of this disclosure is to cover all modifications and embodiments falling fairly within the scope the teachings of the disclosure.

What is claimed is:

1. A thermodynamic cycle, comprising:

a power unit with an engaging element mechanically coupled to the power unit, the engaging element having a first surface and a second surface in opposition thereto, said engaging element being immersed in a gas circulating in a thermodynamic cycle, the first surface contiguous to a high-pressure volume of the thermodynamic cycle, the second surface contiguous to a low-pressure volume, and a venturi in the thermodynamic cycle with a nozzle of the venturi in open communication with the low-pressure volume.

2. The thermodynamic cycle of claim 1, wherein the thermodynamic cycle comprises a primary loop for the circulation of a first portion of the gas of the thermodynamic cycle in an internal portion of the venturi and an auxiliary loop for the circulation of a second portion of the gas of the thermodynamic cycle in the nozzle.

3. The thermodynamic cycle of claim 1, wherein the thermodynamic cycle is a power cycle.

4. The thermodynamic cycle of claim 1, wherein the thermodynamic cycle is a heat or refrigeration cycle.

5. The thermodynamic cycle of claim 2, wherein the primary loop includes piping, a heat exchanger, an electric motor, and the internal portion of the venturi.

6. The thermodynamic cycle of claim 5, wherein the primary loop further includes a valve, a pressure sensor, and a flow control.

7. The thermodynamic cycle of claim 2, wherein the secondary loop includes piping, the high-pressure volume, the low-pressure volume, and the nozzle of the venturi.

8. The thermodynamic cycle of claim 7, wherein the secondary loop further comprises a valve.

9. The thermodynamic cycle of claim 8, wherein the secondary loop further comprises a heat exchanger coil.

10. The thermodynamic cycle of claim 1, wherein the gas is a carbon dioxide gas.

11. The thermodynamic cycle of claim 1, wherein the gas is an argon gas.

12. The thermodynamic cycle of claim 5, wherein the electric motor includes a fan with a variable-speed control.

13. The thermodynamic cycle of claim 12, wherein the fan is a compressor.

14. The thermodynamic cycle of claim 1, wherein the power unit is a turbine.

15. The thermodynamic cycle of claim 14, wherein the engaging element is a blade coupled to the turbine with a rotating shaft.

16. The thermodynamic cycle of claim 15, wherein the low-pressure volume is an exhaust chamber.

17. The thermodynamic cycle of claim 2, wherein a ratio of the first portion over the second portion is greater than 1.

18. The thermodynamic cycle of claim 2, wherein a ratio of the first portion over the second portion is approximately 10.

19. A method of producing a useful effect in a thermodynamic cycle, the method comprising the steps of:

heating a gas to a first state using a heat exchanger;

compressing the gas at the first state to a second state using an electric motor;

directing a first portion of the gas at the second state into an internal portion of a venturi to act as driving element of the venturi, where a nozzle of the venturi is in fluidic contact with an exhaust chamber;

directing a second portion of the gas at the second state into an engaging element of a power unit to produce a useful effect;

releasing the second portion of the gas at the second state in a third state into a exhaust chamber;

collecting through the nozzle the second portion of the gas at the third state in the exhaust chamber; and merging the gas with the first portion of the gas at the second state.

20. The method of producing power in a thermodynamic cycle of claim 19, wherein the useful effect is power.

21. The method of producing power in a thermodynamic cycle of claim 19, wherein the useful effect is heat or refrigeration.

22. The method of producing power in a thermodynamic cycle of claim 19, wherein the gas is a carbon dioxide gas.

23. The method of producing power in a thermodynamic cycle of claim 19, wherein the gas is an argon gas.

24. The method of producing power in a thermodynamic cycle of claim 19, wherein the electric motor is a fan and a compressor.

25. The method of producing power in a thermodynamic cycle of claim 19, wherein the power unit is a turbine.

26. The method of producing power in a thermodynamic cycle of claim 19, wherein a ratio of the first portion over the second portion is greater than 1.

27. The method of producing power in a thermodynamic cycle of claim 19, wherein a ratio of the first portion over the second portion is approximately 10.

* * * * *